US010092948B2

(12) United States Patent
Zhang et al.

(10) Patent No.: US 10,092,948 B2
(45) Date of Patent: Oct. 9, 2018

(54) FLUORIDE-FREE CONTINUOUS CASTING MOLD FLUX FOR LOW-CARBON STEEL

(71) Applicant: Baoshan Iron & Steel Co., Ltd., Shanghai (CN)

(72) Inventors: Chen Zhang, Shanghai (CN); Dexiang Cai, Shanghai (CN); Jianguo Shen, Shanghai (CN); Feng Mei, Shanghai (CN)

(73) Assignee: Baoshan Iron & Steel Co. LTD, Shanghai (CN)

( * ) Notice: Subject to any disclaimer, the term of this patent is extended or adjusted under 35 U.S.C. 154(b) by 239 days.

(21) Appl. No.: 14/386,763

(22) PCT Filed: Mar. 20, 2013

(86) PCT No.: PCT/CN2013/072914
§ 371 (c)(1),
(2) Date: Sep. 19, 2014

(87) PCT Pub. No.: WO2013/139269
PCT Pub. Date: Sep. 26, 2013

(65) Prior Publication Data

US 2015/0101453 A1 Apr. 16, 2015

(30) Foreign Application Priority Data

Mar. 22, 2012 (CN) ..... 2012 1 0078394

(51) Int. Cl.
*B22D 11/11* (2006.01)
*B22D 11/103* (2006.01)

(52) U.S. Cl.
CPC ..... *B22D 11/11* (2013.01); *B22D 11/103* (2013.01)

(58) Field of Classification Search
CPC ..... B22D 11/103; B22D 11/11
(Continued)

(56) References Cited

U.S. PATENT DOCUMENTS

2008/0272100 A1* 11/2008 Amata ..... B23K 35/0261 219/137 R
2011/0005705 A1* 1/2011 Hanao ..... B22D 11/001 164/485

FOREIGN PATENT DOCUMENTS

CN 1666829 A 9/2005
CN 102151812 A 8/2011
(Continued)

OTHER PUBLICATIONS

International Search Report for International Application No. PCT/CN2013/072914 dated Jun. 6, 2013.
(Continued)

*Primary Examiner* — Jenny R Wu
(74) *Attorney, Agent, or Firm* — Lei Fang & Associates LLC; Lei Fang, Esq.

(57) ABSTRACT

The invention provides a fluoride-free continuous casting mold flux for low-carbon steel, comprising, based on weight, $Na_2O$ 5-10%, MgO 3-10%, MnO 3-10%, $B_2O_3$ 3-10%, $Al_2O_3 \leq 6\%$, $Li_2O < 3\%$, C 1-3%, and the balance of CaO and $SiO_2$ as well as inevitable impurities, wherein the ratio of $CaO/SiO_2$ is 0.8~1.3. The mold flux has a melting point of 95~1150° C., a viscosity at 1300° C. of 0.1-0.3 Pa·s, and a crystallization rate of 10-50% as determined according to the method described in the specification for examining crystallization property. The boron-containing, fluoride-free flux developed according to the invention has a moderate crystallization rate, can be used in a crystallizer to control transfer of heat from molten steel effectively, and has been applied successfully in a low-carbon steel slab conticaster with a metallurgical effect that arrives at the level of a traditional fluoride-containing flux to full extent.

7 Claims, 1 Drawing Sheet

(58) Field of Classification Search
USPC ..... 75/305
See application file for complete search history.

(56) References Cited

FOREIGN PATENT DOCUMENTS

| | | | |
|---|---|---|---|
| EP | 0018633 | A2 | 11/1980 |
| EP | 1063035 | A1 | 12/2000 |
| JP | 51-67227 | A | 6/1976 |
| JP | 5-208250 | A | 8/1993 |
| JP | 2005-40835 | A | 2/2005 |
| JP | 2006007316 | A | 1/2006 |

OTHER PUBLICATIONS

CN201210078394.3, "First Office Action", dated Oct. 20, 2014, 7 pages.
CN201210078394.3, "First Search Report", dated Oct. 20, 2014, 7 pages.
CN201210078394.3, "Second Office Action", dated May 11, 2015, 6 pages.
CN201210078394.3, "Supplementary Search Report", dated May 11, 2015, 1 page.
EP13765112, "Supplementary Search Report", dated May 10, 2016, 7 pages.
JP2015-500756, "First Office Action", dated Nov. 29, 2016, 3 pages.
Database WPI Week 200607 Thomson Scientific, London, GB; AN 2006-062144 XP002757100, & JP 2006 007316 A (Sanyi Metallurgical Material Co Ltd) Jan. 2006 (Jan. 12, 2006) "abstract".
RU2014142435, "Office Action", dated Mar. 28, 2017, 6 pages.

* cited by examiner

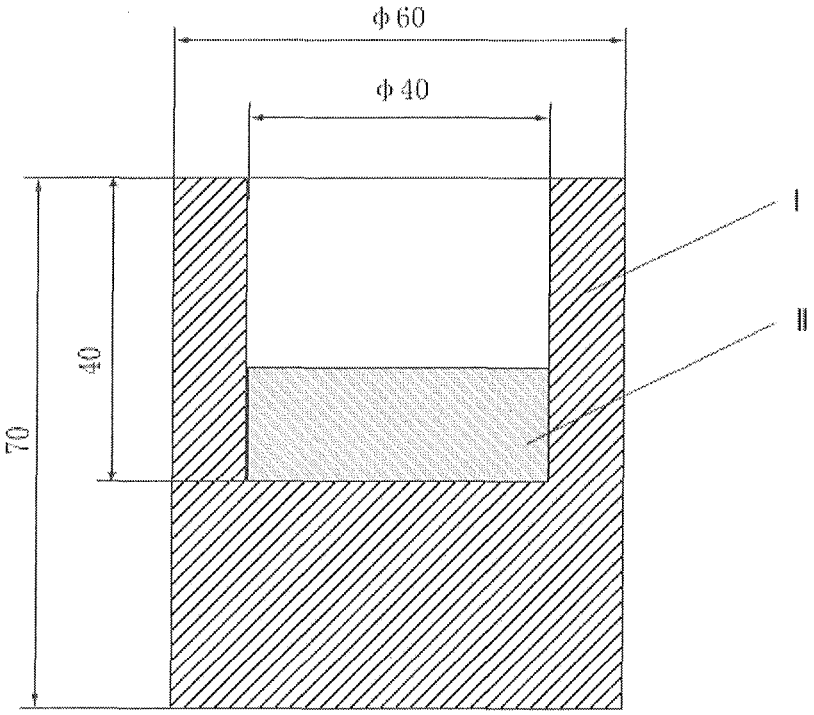
ϕ60
ϕ40
70
40
I
II

FLUORIDE-FREE CONTINUOUS CASTING MOLD FLUX FOR LOW-CARBON STEEL

CROSS-REFERENCE TO RELATED APPLICATIONS

This application is the U.S. National Stage entry of PCT/CN2013/072914, filed Mar. 20, 2013, which claims priority to China Patent Application No. 201210078394.3, filed Mar. 22, 2012.

TECHNICAL FIELD

The invention pertains to the technical field of metallurgy, and particularly relates to an auxiliary material used in a continuous casting process, more particularly to a fluoride-free continuous casting mold flux used in a continuous casting process for low-carbon steel.

BACKGROUND ART

A continuous casting mold flux is a powdery or granular auxiliary material used in steel making for covering the molten steel surface in a crystallizer of a conticaster. Due to high temperature of the molten steel, the mold flux comprises a solid layer and a liquid layer, wherein the molten layer is immediately adjacent to the molten steel, and the part of the mold flux above the molten layer remains in its original granular or powder form so as to achieve good insulation and thus prevent the solidification of the molten steel surface. On the other hand, due to the periodic vibration of the crystallizer, the molten layer flows continuously into a crevice between a copper plate of the crystallizer and an initial shell of the molten steel to lubricate the relative movement between the shell and the copper plate, such that good surface quality of a cast slab is guaranteed. In addition, the molten layer can also absorb nonmetal inclusions floating in the molten steel and purify the molten steel. Generally, the mold flux film flowing into the crevice between the copper plate of the crystallizer and the shell is only 1-2 mm. One side of the film that is adjacent to the copper plate is in solid state, while the other side adjacent to the shell is still in liquid state. The liquid phase has a function of lubrication. The solid phase has good control over the capability of the copper plate of the crystallizer in cooling the shell, such that the cooling rate of the molten steel may be regulated and the controlled heat transfer can be achieved. Hence, a mold flux is the last process technique for controlling the surface quality of a cast slab in steel making. A mold flux with inappropriate properties may induce surface deficiencies such as flux inclusions, cracks, etc. to the cast slab. More seriously, the shell may even break and an accident of steel leakage may be incurred. Therefore, a mold flux is an important means for guaranteeing successful proceeding of a continuous casting process and surface quality of a cast slab.

A continuous casting mold flux is mainly a binary system of CaO and $SiO_2$, accompanied with fusion aids such as $CaF_2$, $Na_2O$, $Li_2O$ and the like to lower melting point and viscosity of the binary system of CaO and $SiO_2$, further with a small amount of such components as $Al_2O_3$, MgO, MnO, $Fe_2O_3$ and the like to obtain desirable metallurgical properties. Since the melting point of a mold flux is about 400° C. lower than the temperature of molten steel, an amount of carbonaceous material must be added to allow slow melting of the mold flux having a relatively low melting point on the molten steel surface. The carbonaceous material that has a very high melting point can stop agglomeration of liquid drops of the mold flux effectively, and thus retard melting of the mold flux. To the extent of these components of the mold flux, the ratio of CaO to $SiO_2$ (i.e. $CaO/SiO_2$, referred to as basicity hereafter) and the amount of F may be regulated to have an effective control over the crystallization rate of cuspidite ($3CaO.2SiO_2.CaF_2$) in order to fulfill the purpose of adjusting the mold flux reasonably and controlling heat transfer accordingly. Higher crystallization rate results in higher thermal resistance of the mold flux and lower heat transfer intensity. Fully vitrified mold flux has the minimum thermal resistance and the maximum heat transfer intensity. For low-carbon steel, ultralow-carbon steel and those types of steel having poor thermal conductivity (e.g. silicon steel, etc.), in order to reinforce cooling of cast slabs, crystallization of the mold flux is undesirable. Hence, the amount of F is generally low, specifically about 3-5%. However, for peritectic steel and those types of steel containing crack-sensitive elements, if the cooling of molten steel in a crystallizer is uneven or too fast, the initial shell will break readily at weak locations under various stresses, resulting in longitudinal cracks. For these types of steel, the mold flux must have a high crystallization rate to effect slow cooling and inhibition of cracking. In these circumstances, the content of F in the mold flux is often as high as 8-10%. It can be seen that F is used in a mold flux not only for lowering melting point and viscosity, but also plays an important role in increasing crystallization rate. Thus, F is an indispensable element in a traditional mold flux.

It is well known that F is a toxic element whose harm to human beings, animals and plants is at a level 20 times higher than the harm level of sulfur dioxide. Due to high working temperature of the mold flux, generally about 1500° C., a large quantity of environmentally harmful fluoride gases (including $SiF_4$, HF, NaF, $AlF_3$, etc.) are produced in melting process. Fluorides in air, especially HF, are among the common air pollutants. Additionally, after exiting the crystallizer, the molten mold flux that has high temperature contacts with secondary cooling water sprayed on a cast slab at high speed, and they interact with each other to undergo the following reaction:

$$2F^- + H_2O = O^{2-} + 2HF$$

When HF dissolves in water, fluoride ion concentration and pH of the secondary cooling water are increased. As the secondary cooling water is recycled, fluoride ions will be further enriched, and pH will be further increased. The increase of the fluoride ion concentration and pH of the secondary cooling water accelerates corrosion of the continuous casting equipment greatly, leading to higher maintenance fee of the equipment, higher difficulty and neutralizer cost in treatment of the recycling water, and higher burden of sewage discharge.

In view of the above problems concerning a F containing flux, both domestic and foreign metallurgists have been devoting themselves actively to the development of environmentally friendly mold fluxes free of F. At present, a relatively feasible solution involves replacement of F with $B_2O_3$, $Li_2O$, and a suitable combination of which with $Na_2O$ effects adjustment of the melting properties of a mold flux. Japanese patent publications JP2007167867A, JP2000169136A, JP2000158107A, JP2002096146A and Chinese patent application CN201110037710.8 disclose solutions in which no $B_2O_3$ or a small amount of $B_2O_3$ is added. According to these solutions, the melting point or the viscosity of the mold flux is generally rather high. Specifically, the melting point is higher than 1150° C., or the viscosity at 1300° C. is higher than 0.5 Pa·s. Unduly high melting point or viscosity renders consumption of liquid flux excessively low, which is unfavorable for cast slab quality and smooth proceeding of a continuous casting process. In order to develop a fluoride-free mold flux being valuable in industrial application, the cost of raw materials has to be taken into consideration. Inasmuch as $Li_2O$ is expensive, the technology using $B_2O_3$ in replace of F is most promising for application. Because the melting point of $B_2O_3$ is only on the order of 450° C., far lower than those of the other components of a boron-containing mold flux, the softening temperature of the solid phase of the mold flux is apparently rather low. Consequently, the proportion of the solid phase in the flux film located in the crevice between the copper plate of the crystallizer and the shell is rather low, resulting in lowered thermal resistance of the flux film and rather high heat flow in the crystallizer. In addition, $B_2O_3$ in the mold flux tends to have a network structure, which inhibits crystallization. As a result, the solid phase has a vitreous structure. A vitreous solid phase has lower thermal resistance than a crystalline solid phase. Therefore, a boron-containing flux has lower thermal resistance than a traditional fluoride-containing flux. Once the excessively high heat flow exceeds the limit designed for a caster, not only the service life of the crystallizer will be affected, but the risk of sticking breakout will be increased. Hence, the heat flow must be curbed. Under normal conditions, a crystallizer in a continuous slab casting process has a comprehensive heat transfer coefficient of 900-1400 $W/m^2K$. Additionally, the comprehensive heat transfer coefficient increases as the draw speed is increased. Thus, in the case where a boron-containing flux is used in production, the comprehensive heat transfer coefficient of the crystallizer will reach an upper limit of 1300-1400 $W/m^2K$ when the draw speed is 1.0 m/min. However, the draw speed of existing domestic and foreign slab casters in operation is basically 1.2 m/min. For low-carbon steel and ultralow-carbon steel, the draw speed is even up to 1.6 m/min or higher. When these types of steel are concerned, a normal production rhythm can hardly be realized using a boron-containing, fluoride-free flux. This deficiency has to be remedied by enhancing the crystallization rate of the boron-containing flux. Japanese patent publication JP2001205402A and Chinese patent application CN200510065382 disclose boron-containing, fluoride-free fluxes, but crystallization rate is not taken into account. Hence, the mold fluxes must face the risk of unduly high heat transfer property during use. The mold flux disclosed by Chinese patent application CN200810233072.5 has an excessively high crystallization rate, and thus it is only adapted to crack-sensitive steel such as peritectic steel, etc. Chinese patent application CN03117824.3 proposes perovskite ($CaO.TiO_2$) as the subject of crystallization. However, the melting point of perovskite is higher than 1700° C., which is unfavorable for lubrication. Thus, its prospect of application is limited. The mold flux designed in Chinese patent application CN201010110275.2 uses a composite crystalline phase of merwinite and sodium xonotlite. However, its viscosity is rather high, and thus it is more suitable for a billet continuous casting process.

As mentioned above, F, as an indispensable component in a traditional mold flux, has the function of lowering melting point and viscosity of the flux, and is an important means for controlling heat transfer in a continuous casting crystallizer. However, due to its harm to human health, pollution of atmosphere and water, and accelerated corrosion of equipments, it is a research subject on which those skilled in the art are concentrated to obtain a fluoride-free continuous casting mold flux. The cost of a mold flux free of fluoride is also an important concern that must be considered for its industrial application on a large scale. Currently, substitution of $B_2O_3$ for F is the most economical and feasible technical concept. The biggest deficiencies of a boron-containing flux include its low crystallization rate and lowered softening point of solid phase, resulting in small thermal resistance of the boron-containing flux in use and excessive heat transfer of a continuous casting crystallizer, which is unfavorable for increase of the draw speed of a conticaster and restricts the output of a steel plant. The inventors of the present invention have developed a boron-containing, fluoride-free flux having a moderate crystallization rate, which can be used in a crystallizer to control transfer of heat from molten steel effectively, and has been applied successfully in a low-carbon steel slab conticaster.

SUMMARY

The object of the invention is to provide a fluoride-free continuous casting mold flux for low-carbon steel.

The fluoride-free continuous casting mold flux for low-carbon steel provided by the invention comprises, based on weight, $Na_2O$ 5-10%, MgO 3-10%, MnO 3-10%, $B_2O_3$ 3-10%, $Al_2O_3 \leq 6\%$, $Li_2O < 3\%$, C 1-3%, and the balance of CaO and $SiO_2$ as well as inevitable impurities, wherein the weight ratio of $CaO/SiO_2$ is 0.8~1.3.

50 g of the fluoride-free continuous casting mold flux for low-carbon steel according to the invention is melted at 1350° C. and then poured into a steel crucible to be cooled naturally. The crystallization rate of the mold flux is characterized by the proportion of crystals at a section and ranges between 10% and 50%.

In a preferred embodiment, the content of $Na_2O$ is preferably 6-9.5%, more preferably 6-9%.

In a preferred embodiment, the content of MgO is preferably 3-9%, more preferably 5-9%, and most preferably 5-8%.

In a preferred embodiment, the content of MnO is preferably 5-10%, more preferably 5-9%.

In a preferred embodiment, the content of $B_2O_3$ is preferably 4-10%, more preferably 4-8%.

In a preferred embodiment, the content of $Al_2O_3$ is preferably 0.5-6%, more preferably 1-5%.

In a preferred embodiment, the content of $Li_2O$ is preferably ≤2.5%, more preferably 1-2.5%.

In a preferred embodiment, the content of C is preferably 1.3-2.8%.

The mold flux according to the invention is a fluoride-free, environment-friendly mold flux for low-carbon steel and has a composition based on a CaO—$SiO_2$ binary system accompanied with an amount of $Na_2O$, $B_2O_3$, $Li_2O$ as fusion aids and other components such as MgO, MnO, $Al_2O_3$, etc. In order to guarantee rapid and even melting of the mold flux, after mixing at a target composition, these raw materials of the mold flux are subjected to pre-melting treatment in advance. As such, a complex solid solution is formed from these substances, so that the melting points of these substances tend to be close to each other. Thus, the melting temperature region of the mold flux, i.e. the difference between the temperature at which the melting ends and the temperature at which the melting starts, can be controlled within a narrow range. The pre-melted mold flux needs mild adjustment in accordance with compositional deviation, but the proportion of the pre-melted material should not be less than 70%. At the same time, a suitable amount of carbonaceous material such as carbon black, graphite and the like is added. The mold flux also comprises some impurities carried by the raw materials inevitably, and the amount of these impurities should be controlled at 2% or lower.

The fluoride-free continuous casting mold flux for low-carbon steel according to the invention has the following physical properties: melting point between 950° C. and 1150° C., viscosity at 1300° C. between 0.1 Pa·s and 0.3 Pa·s, and crystallization rate between 10% and 50%. The crystallization rate of a mold flux is closely related to the examination method. Generally, according to the simplest and most effective method, a fully melted mold flux is poured into a vessel at ambient temperature for cooling. After solidified thoroughly, the flux body is examined for the proportion of crystals, which is used to characterize the crystallization intensity of the mold flux. This value is closely related to the amount of the flux, the temperature for melting the flux, and the size, shape and material of the vessel at ambient temperature. Higher crystallization rate will be measured with larger amount of the flux, higher temperature for melting the flux, or poorer heat diffusion ability of the vessel. To enable comparison between the crystallization rates of different mold fluxes, the following examination process is employed in the invention:

(1) As the mold flux suffers from certain burning loss, the value of burning loss should be considered correspondingly when the flux is weighed, so that the weight of the melted liquid flux remains within 50±2 g. If a product flux is measured, a decarbonization treatment should be subjected to the mold flux beforehand;

(2) The weighed mold flux is contained in a high-purity graphite crucible and heated at a temperature of 1350±10° C. until the flux is melted fully;

(3) The graphite crucible containing the molten flux is taken out, and the flux is poured rapidly into a steel crucible at ambient temperature for cooling, wherein the specific dimensions of the steel crucible are shown in FIG. 1;

(4) After the molten flux is solidified completely, the flux body is removed, and the proportion of crystals at the section of the flux body is measured. The measured proportion value is taken as the crystallization rate of the mold flux and used to characterize the crystallization intensity of the mold flux;

(5) The invention requires that the crystallization rate of the mold flux be controlled at 10-50%.

The basicity as required by the mold flux of the present invention, i.e. the ratio of $CaO/SiO_2$, is typically controlled at 0.8-1.3, such that a certain crystallization amount can be ensured on the one hand, and a lubrication effect can be achieved between the copper plate of the crystallizer and the shell on the other hand.

$Na_2O$ is a common fusion aid used for the mold flux. It can lower melting point and viscosity of the mold flux effectively and has a typical content of 5% and higher. Additionally, the presence of $Na_2O$ can boost precipitation of crystals such as sodium xonotlite ($Na_2O.CaO.SiO_2$), nepheline ($Na_2O.Al_2O_3.2SiO_2$), etc. If its content is higher than 10%, the crystallization rate will be too high, such that the melting point and the viscosity tend to rise instead, which is undesirable for the lubrication effect of the liquid flux on the cast slab. In addition, an unduly high crystallization rate renders the thermal resistance of the flux film excessively high, such that the shell of the molten steel grows too slowly, which is unfavorable for increase of the draw speed of the caster and thus affects the output of a steel plant.

Addition of a suitable amount of MgO into a mold flux may lower viscosity of the molten flux, and thus remidies the function of F in lowering viscosity in the case of a fluoride-free flux. Along with the increase of the MgO content, the crystallization rate of the molten flux also increases gradually, wherein merwinite ($(3CaO.MgO.2SiO_2)$, bredigite ($7CaO.MgO.4SiO_2$) and akermanite ($2CaO.MgO.2SiO_2$) are the most common crystalline forms. If its content is higher than 10%, the crystallization rate becomes too large, which is also unfavorable for continuous casting production of low-carbon steel.

The presence of MnO can also lower melting point and viscosity to certain extent. In addition, Mn is a black metal, and its oxides may darken the transparency of glass, such that the rate of heat diffusion by radiation of molten steel is decreased significantly. This also achieves the effect of increasing thermal resistance of the mold flux film. As an oxide of a transition element, MnO is prone to substituting MgO in the crystalline structure or coexisting with MgO to form a composite crystal. Hence, its amount should not be too high, either, and typically, is desirably controlled at 10% or less.

As an important fusion aid in a fluoride-free flux, $B_2O_3$ is a major regulating measure for controlling melting point, viscosity and crystallization rate of the mold flux. As the content of $B_2O_3$ increases, the precipitation rate of the above stated crystals in the mold flux will decrease gradually. However, excessive addition will produce calcium borosilicate ($11CaO.4SiO_2.B_2O_3$) or federovskite ($CaO.MgO.B_2O_3$) crystals. In so far the melting point of $B_2O_3$ is only about 450° C., the melting points of these boron-containing crystals are also rather low. In addition, the crystalline structure is so dense that intercrystalline holes can not form easily. This is manifested by the fact that boron-containing crystals have significantly lower thermal resistance than other crystals. In order to prevent excessive precipitation of boron-containing crystals, the addition amount of $B_2O_3$ should not be higher than 10%.

$Al_2O_3$ is a common impurity component in the raw materials of a mold flux. The presence of $Al_2O_3$ may increase viscosity of the mold flux and lower crystallization rate. Thus, its content should be controlled at 6% or less.

$Li_2O$ can significantly lower melting point and viscosity of a mold flux. However, its price is very high, more than 20 times higher than that of fluorite (the form in which F is added into a flux). Hence, excessive addition may increase the raw material cost of the mold flux remarkably, which is undesirable for industrial application of a fluoride-free mold flux. Therefore, $Li_2O$ is usually used as an auxiliary fusion aid, and added appropriately when the melting point and the viscosity are undesirably high. Considering from a perspective of cost, the amount should not exceed 3%.

Since the melting point of a mold flux is about 400° C. lower than that of molten steel, carbonaceous material is necessary for controlling steady melting of the mold flux on the surface of the molten steel and maintaining a certain thickness of a powder flux layer (which has an effect of insulation). Carbon is a substance having a high melting point, and can prevent agglomeration of liquid drops of a melted flux. In addition, carbon will burn and produce gas, and thus will not pollute the mold flux. In the case of a mold flux for continuous casting of low-carbon steel slabs, it is appropriate to add 1-3% carbon.

The fluoride-free, environment-friendly mold flux according to the invention can be used in a crystallizer to control transfer of heat from molten steel effectively by controlling crystallization rate suitably. The mold flux has been applied successfully in a low-carbon steel slab conticaster, and the metallurgical effect arrives at the level of a traditional fluoride-containing flux to full extent. The application scope of a boron-containing, fluoride-free flux is thus expanded effectively. Since this mold flux does not contain F which is harmful to human body and environment, it can be called a green product. As verified by field use, in addition to extending the service life of an immersed nozzle in continuous casting, the use of the fluoride-free mold flux does not lower pH of secondary cooling water, such that corrosion of the equipment is alleviated significantly. Furthermore, enrichment of fluorides in the secondary cooling water will not occur any more. Consequently, the burden of treating and discharging recycling water can be relieved remarkably. The fluoride-free continuous casting mold flux for low-carbon steel according to the invention has a melting point of 950-1150° C., a viscosity at 1300° C. of 0.1-0.3 Pa·s, and a crystallization rate of 10-50%. When the mold flux is used, it can meet the full requirement of continuous casting production of low-carbon steel with a use effect equivalent to that of a traditional fluoride-containing flux.

DESCRIPTION OF DRAWINGS

FIG. 1 shows a steel crucible for measuring the crystallization property of a mold flux, wherein I refers to steel crucible, and II refers to flux body.

DETAILED DESCRIPTION OF THE INVENTION

The invention will be described in more detail with reference to the following examples. These examples are only intended to describe the most preferred embodiments of the invention without limiting the scope of the invention.

Examples 1-7

The following raw materials (without limitation) were used to prepare a mold flux: limestone, quartz, wollastonite, magnesite clinker, bauxite, soda, borax, borocalcite, manganese carbonate, pigment manganese, lithium carbonate, lithium concentrate, etc.

The above raw materials were ground into fine powder, mixed homogeneously at a target composition, and then pre-melted to form a complex solid solution from these substances and release carbonates and volatiles such as water, etc. A pre-melted material having faster melting speed and better homogeneity was obtained, followed by cooling, breaking and secondary grinding into fine powder having a particle size of less than 0.075 mm. On the ground of compositional deviation, mild adjustment was conducted using the above stated raw materials, wherein the pre-melted material accounted for not less than 70%. Subsequently, a suitable amount of carbonaceous material such as carbon black, graphite and the like was added, mixed mechanically, or treated using a spray drying device to give a granular product flux.

The table below shows the compositions of the mold fluxes of the examples. Compared with the comparative examples, the mold flux of the invention has the same capability of heat transfer as a traditional fluoride-containing flux, such that the problems of unduly high capability of heat transfer of the crystallizer and inability of the caster in achieving normal draw speed, which tended to occur in the comparative examples, are eliminated.

| | | Comparative Examples | | Examples | | | | | | |
|---|---|---|---|---|---|---|---|---|---|---|
| | | ① | ② | ① | ② | ③ | ④ | ⑤ | ⑥ | ⑦ |
| Chemical composition % | CaO | 37 | 33.5 | 34.2 | 33 | 33 | 38 | 35 | 31 | 31 |
| | $SiO_2$ | 33 | 32 | 30 | 33 | 33.5 | 29.5 | 29 | 38.5 | 34.5 |
| | $Al_2O_3$ | 3 | 4 | 5 | 3 | 3 | 6 | 5 | 0.5 | 1 |
| | MgO | 3 | 3.5 | 6 | 8 | 6 | 5 | 3 | 9 | 6 |
| | MnO | 5 | 4.5 | 5 | 5 | 10 | 3 | 5 | 5 | 9 |
| | $Na_2O$ | 9 | 12 | 9 | 8 | 6 | 6 | 9.5 | 9 | 9 |
| | $B_2O_3$ | 4 | 6.5 | 7.5 | 4 | 4 | 8 | 10 | 3 | 6 |
| | $Li_2O$ | 1 | 0.5 | 1 | 2.5 | 1 | 1.5 | 0 | 1 | 1 |
| | C | 2.3 | 2.4 | 2.4 | 2.6 | 2.0 | 1.3 | 2.8 | 1.8 | 1.6 |
| $CaO/SiO_2$ | | 1.12 | 1.05 | 1.14 | 1.00 | 0.99 | 1.29 | 1.21 | 0.81 | 0.90 |
| Melting point ° C. | | 1045 | 985 | 1040 | 1010 | 1065 | 1140 | 970 | 1105 | 1080 |
| Viscosity at 1300° C. Pa · s | | 0.20 | 0.22 | 0.20 | 0.18 | 0.24 | 0.15 | 0.12 | 0.30 | 0.26 |
| Crystallization rate % | | 3 | 0 | 15 | 45 | 35 | 30 | 10 | 22 | 17 |
| Heat transfer capability | | Excessively high | Excessively high | Moderate | Moderate | Moderate | Moderate | Moderate | Moderate | Moderate |

The invention claimed is:

1. A fluoride-free continuous casting mold flux suitable for producing low-carbon steel, consisting of, based on weight, $Na_2O$ 6-9.5%, MgO 3-10%, MnO 3-10%, $B_2O_3$ 3-4%, $Al_2O_3 \leq 6\%$, $Li_2O < 3\%$, C 1-3%, the balance of CaO and $SiO_2$, and inevitable impurities, wherein the weight ratio of $CaO/SiO_2$ is 0.8~1.0; wherein the crystallization rate of the mold flux ranges from 22% to 50% as characterized by the proportion of crystals at a section when 50g of the mold flux is melted at 1350° C. and then poured into a steel crucible to be cooled naturally; and wherein said mold flux has melting point and viscosity of heat transfer capability suitable for producing low carbon steel in a continuous casting system.

2. The fluoride-free continuous casting mold flux of claim 1, wherein said MgO is 5-9% by weight.

3. The fluoride-free continuous casting mold flux of claim 1, wherein said MnO is 5-9% by weight.

4. The fluoride-free continuous casting mold flux of claim 1, wherein said $Al_2O_3$ is 0.5-6% by weight.

5. The fluoride-free continuous casting mold flux of claim 1, wherein said $Li_2O$ is ≤2.5% by weight.

6. The fluoride-free continuous casting mold flux of claim 1, wherein the said C is 1.3-2.8% by weight.

7. The fluoride-free continuous casting mold flux of claim 1, wherein said melting point is 1010-1150° C. and said viscosity is 0.1-0.3 Pa·s at 1300° C.

* * * * *